United States Patent [19]

Bertschmann

[11] 4,076,440

[45] Feb. 28, 1978

[54] EXPANSION JOINT BRIDGING DEVICE

[76] Inventor: Silvio Bertschmann, Lindenhohe, 6045 Meggen (Kt. Luzern), Switzerland

[21] Appl. No.: 709,658

[22] Filed: Jul. 29, 1976

[30] Foreign Application Priority Data

Jul. 29, 1975 Switzerland ..... 9852/75

[51] Int. Cl.[2] ..... E01C 11/02

[52] U.S. Cl. ..... 404/69; 14/16.5; 52/396

[58] Field of Search ..... 404/69, 68, 47; 14/16.5; 52/396

[56] References Cited

U.S. PATENT DOCUMENTS

| | | | |
|---|---|---|---|
| 3,113,493 | 12/1963 | Rinker | 404/47 |
| 3,482,492 | 12/1969 | Bowman | 14/16.5 X |
| 3,604,322 | 9/1971 | Koster | 14/16.5 X |
| 3,698,292 | 10/1972 | Koster | 14/16.5 X |
| 3,732,021 | 5/1973 | Rizza | 14/16.5 X |
| 3,797,188 | 3/1974 | Mansfeld | 404/68 X |
| 3,797,952 | 3/1974 | Pommerening | 14/16.5 |
| 3,854,159 | 12/1974 | McLean | 14/16.5 |
| 3,904,302 | 9/1975 | Bertschmann | 404/68 |
| 3,904,303 | 9/1975 | Becht | 404/68 |

*Primary Examiner*—Nile C. Byers
*Attorney, Agent, or Firm*—William Anthony Drucker; William Anthony Drucker

[57] ABSTRACT

A device for bridging expansion joints in roadways, comprising edge plates anchored in the edges of the roadway to be joined together, an intermediate plate between the edge plates, a resilient seal between the intermediate plate and each edge plate, and flexible lateral supports depending from the intermediate and edge plates and connected together at their ends remote from the plates.

15 Claims, 39 Drawing Figures

FIG. 12
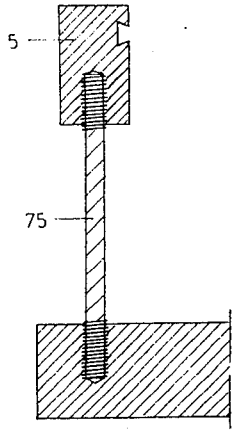
FIG. 13
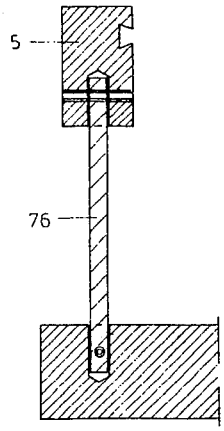
FIG. 14
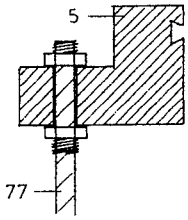
FIG. 15
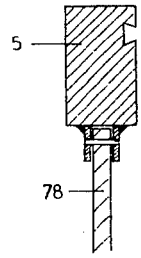
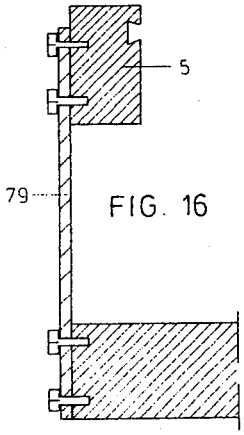
FIG. 16
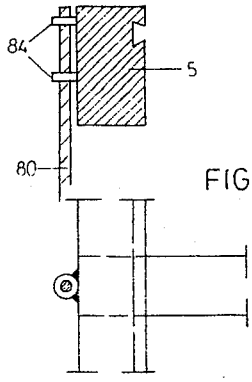
FIG. 17

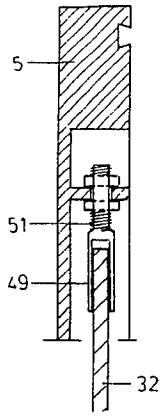
FIG. 18
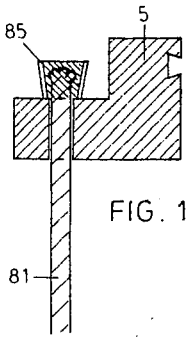
FIG. 19
FIG. 20
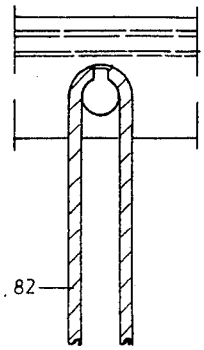
FIG. 21
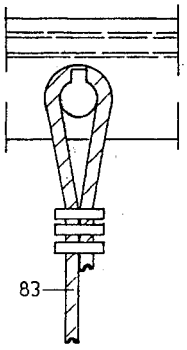
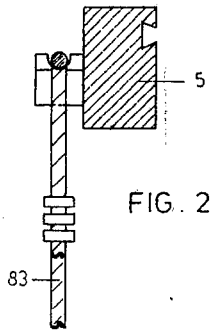
FIG. 22

FIG. 26
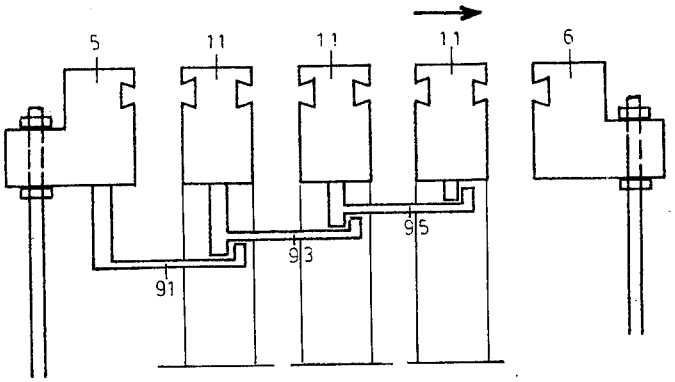
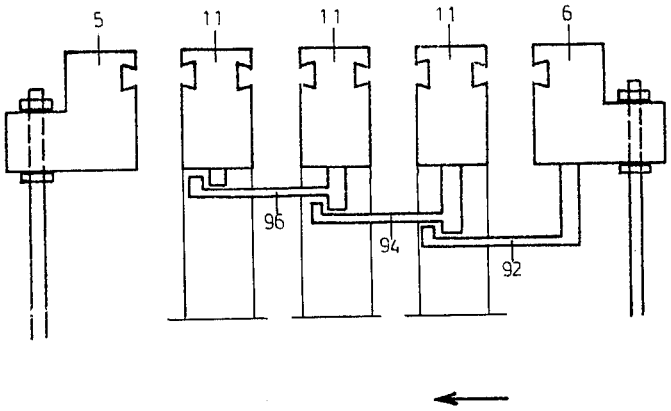
FIG. 27

EXPANSION JOINT BRIDGING DEVICE

BACKGROUND OF THE INVENTION

1. Field of the Invention.

The present invention relates to a device for bridging over the expansion joints in roadways and the like, especially in bridge roadway.

2. Description of the Prior Art.

Known devices for bridging over expansion joints comprise sliding and rubbing components which render possible the opening and closing of the joint. Deterioration of the mobility under the action of dirt, corrosion and wear can cause these known devices to become useless in time. Moreover such designs require very great precision in production.

Another known device according to Swiss Pat. No. 440,360 consists of thin-walled carrier rods of zig-zag or undulatory form arranged in the direction of movement which are connected with beams extending parallel with the joint edges. Such a device has the disadvantage that it cannot be made watertight, since the two-dimensional movements of the gaps render secure sealing impossible. Moreover the carriers with undulatory or zig-zag course with thin walls must be made easily deformable, which is not possible in the case of wide joints requiring strong rods. The requisite bearing capacity and elasticity can be achieved only limitedly with small joints.

A further device according to U.S. Pat. No. 2,797,952 comprises plates which are supported on trusses of articulated rods connected with the joint edges. Unavoidable forces acting in the transverse direction of the roadway cannot be taken up. The joints, which are heavily stressed under the traffic load, are prone to wear and in time troublesome chattering noises are to be expected. The design requires high production precision. Arrangement of seals in the plate interspaces is possible. A further device according to U.S. Pat. No. 3,904,302 comprises a plurality of rigid strips and elastomeric strips between adjacent rigid strips which extend longitudinally through the gap. Upper ends of the legs are connected to the rigid strips. Lower ends of the legs are interconnected with each other in pairs whereby adjacent legs form a pair and an elastically yielding structure. This design has the disadvantage that the legs and the elastically deformable rigid strips must take up the bending moments from the traffic load. For this reason this system without additional supporting can be used sensibly and economically only to bridge over minor joints.

SUMMARY OF THE INVENTION

The device according to the invention has:

a. a first edge plate extending in the joint longitudinal direction arranged at roadway level and anchored in one joint edge;
b. a second edge plate extending in the joint longitudinal direction, arranged at roadway level and anchored in the other joint edge;
c. at least one intermediate plate arranged between and spaced from said first and second edge plates;
d. elastically deformable seal elements provided between said intermediate plate and said first and second edge plates;
e. first downwardly extending flexible lateral supports supporting said first edge plate;

f. second downwardly extending flexible lateral supports supporting said second edge plate; and
g. downwardly extending intermediate supports supporting the intermediate plate.

The invention is based upon the problem of producing a watertight roadway transition which has no sliding and rubbing parts, is resistant to wear and the operation of which is not impaired by the action of dirt and corrosion, further which renders possible the expansion and contraction of the joint and even in the case of wider joints possesses the requisite bearing capacity without additional supporting constructions; moreover such a roadway transition should be capable of being produced without high production precision. For this purpose in the device according to the invention the intermediate supports are each connected to at least one of the first lateral supports and to at least one of the second lateral supports.

BRIEF DESCRIPTION OF THE DRAWINGS

FIGS. 1*a* to 7*a* show the pertinent plan views without the seal elements arranged between the plates;

FIGS. 8*a* to 10*a* show the associated plan views;

FIGS. 12 to 25 show various examples of embodiment of the connection of side supports with the edge plates and partly also with the supports; and FIGS. 26 and 27 show a device for limiting the horizontal movement of the intermediate plates.

DESCRIPTION OF THE PREFERRED EMBODIMENT

Figure 1:
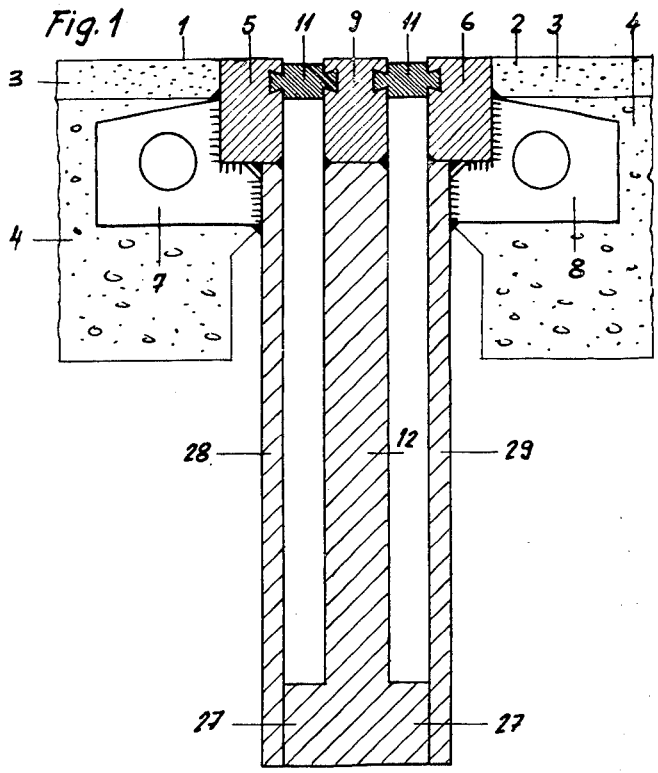
FIGS. 1 to 7 show seven different examples of embodiment of expansion joints having three plates, in vertical cross-section.
Figure 1A:
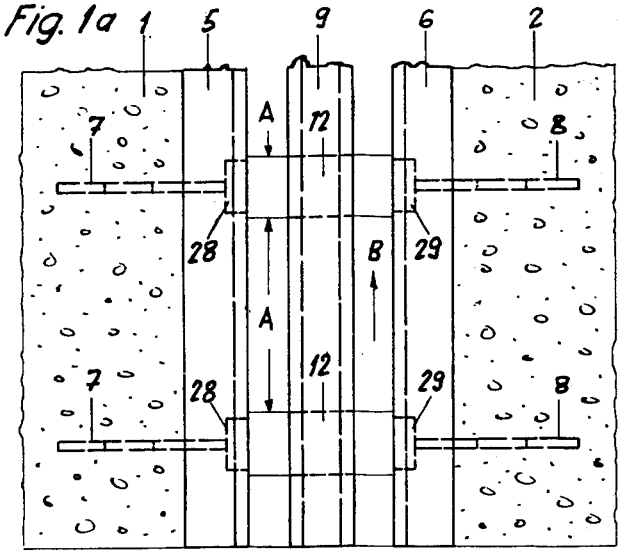
Figure 2:
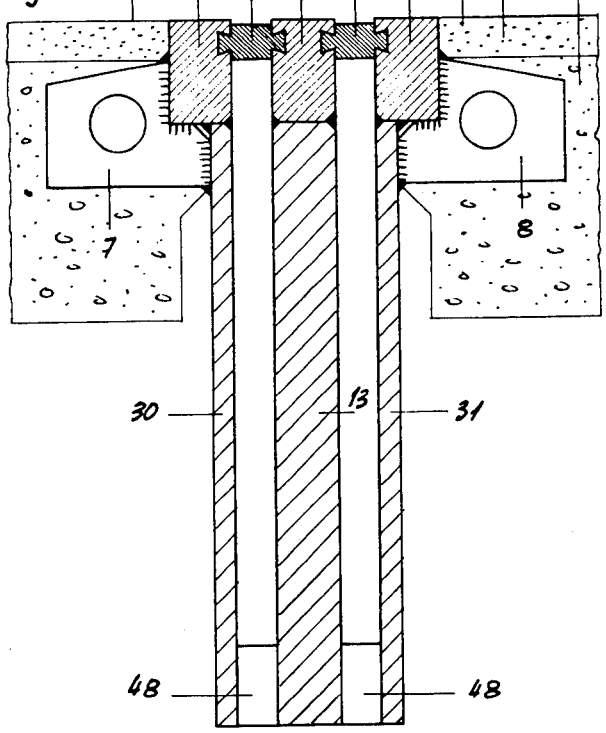

In the example according to FIGS. 1 and 1*a*, 1 and 2 designate the two joint edges of the roadway with the roadway flooring 3 and the roadway sub-structure 4. 5 and 6 designate the two edge plates arranged at roadway level, which are anchored in the roadway substructure 4 by means of welded-on fins 7 and 8. 9 is an intermediate plate arranged with spacing from the two edge plates 5, 6. The interspaces between the plates are sealed off in known manner by means of elastically deformable seal elements 11 inserted in shape-locking manner into the plates. The intermediate plate 9 is supported on several vertically downwardly extending supports 12 and connected in bending-resistant manner therewith, for example by welding. As may be seen from FIG. 1, the supports 12 are made in inverted T-form in vertical cross-section and merge at the lower end into horizontally protruding legs 27. 28, 29 designate lateral supports formed as flat sections which are elastically flexible in the longitudinal direction of the roadway, are each welded at the upper end with the edge plates 5, 6 and extend like the supports 12 vertically downwards, where they engage with their lower ends on the legs 27 of the supports 12 or are welded or otherwise rigidly connected with these. For the support of the intermediate plate 9 various supports 12 are arranged, namely at intervals A extending in the longitudinal direction B of the joint. Two of these supports may be seen in FIG. 1*a*.

Figure 2A:
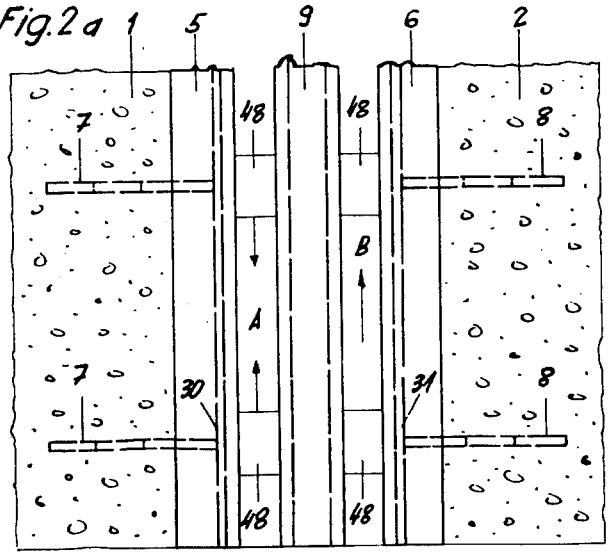

In the example of embodiment according to FIGS. 2 and 2*a*, parts formed the same are designated in the same way as in the above-described example of embodiment. 13 designates a support standing on edge an welded in bending-resistant manner to the intermediate plate 9, the lower end of which support is rigidly connected by intermediate pieces 48 arranged at intervals A from one another with the lateral supports 30, 31 of plate form which are elastically flexible in the longitudinal direction of the roadway. Supports 13 and lateral supports can extend over the whole joint length or over only parts thereof.

Figure 3:
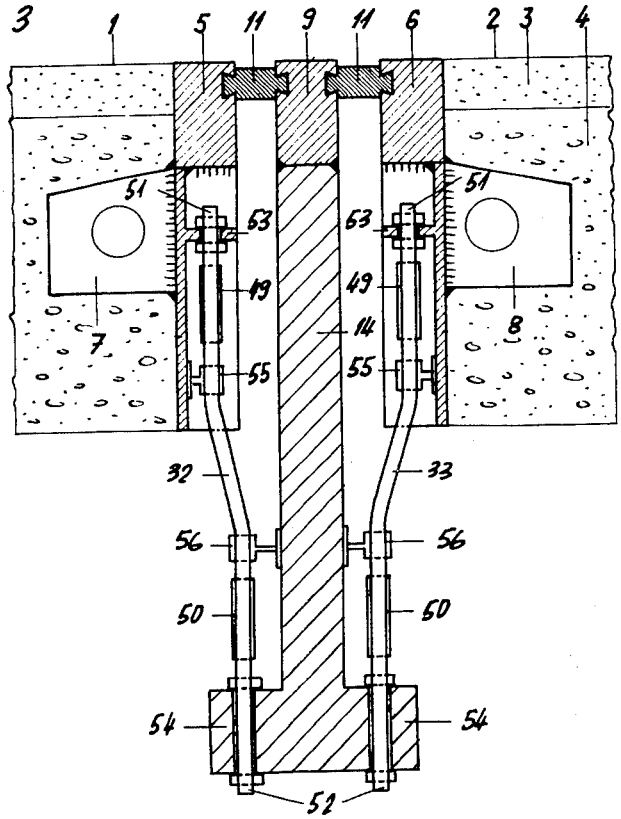
Figure 3A:
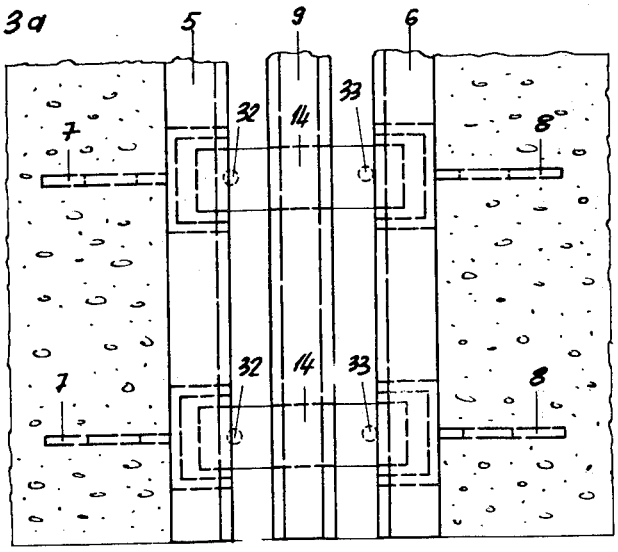

In the example of embodiment according to FIGS. 3 and 3*a*, tension cables 32 and 33 serve as lateral supports for the supports 14 of inverted T-form. The ends of these tension cables are connected by means of press-on threaded bushes 49 and 50 (see also FIG. 18) with threaded bolts 51 and 52 which are secured at one end on protruding arms 53 welded to the anchor fins 7, 8 and at the other in the legs 54 of the supports 14. In order to avoid an oblique traction upon the threaded bolts 51, 52, deflector elements 55, 56 serving as guide for the cables 32 and 33 are secured on the one hand to the roadway sub-structure 4 and on the other to the support 14. On a movement of the intermediate plate 9 transversely of the joint the cables incline differently in relation to the roadway surface, so that uniform gap widths occur between the plates.

Figure 4:
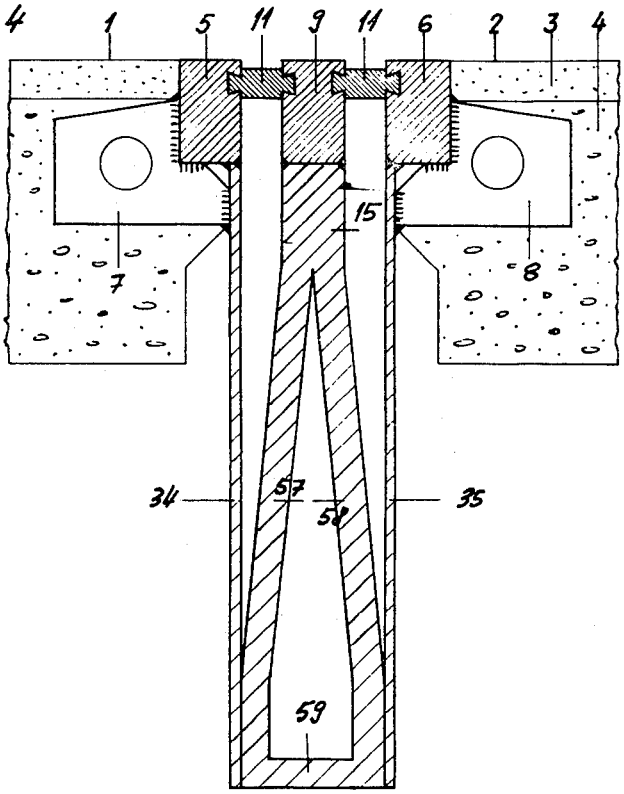
Figure 4A:
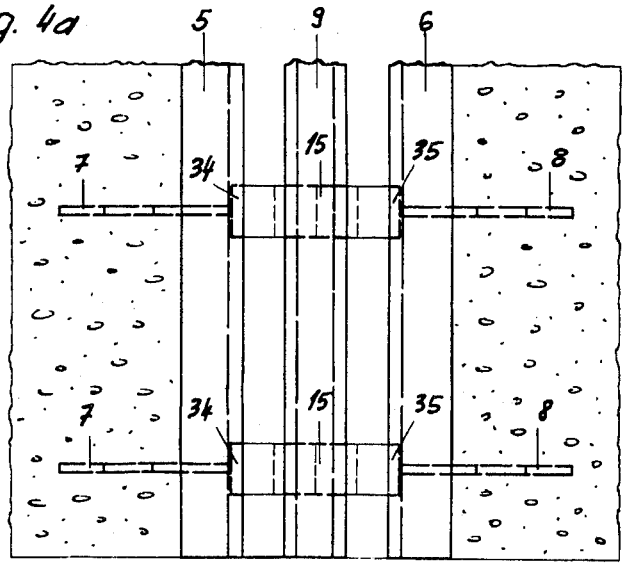

In the example of embodiment according to FIGS. 4 and 4*a* the supports 15 have downwardly diverging legs 57, 58 which are connected with one another at the lower end by a cross-piece 59. Thin flat sections 34 and 35 serve as lateral supports for the supports 15.

Figure 5:
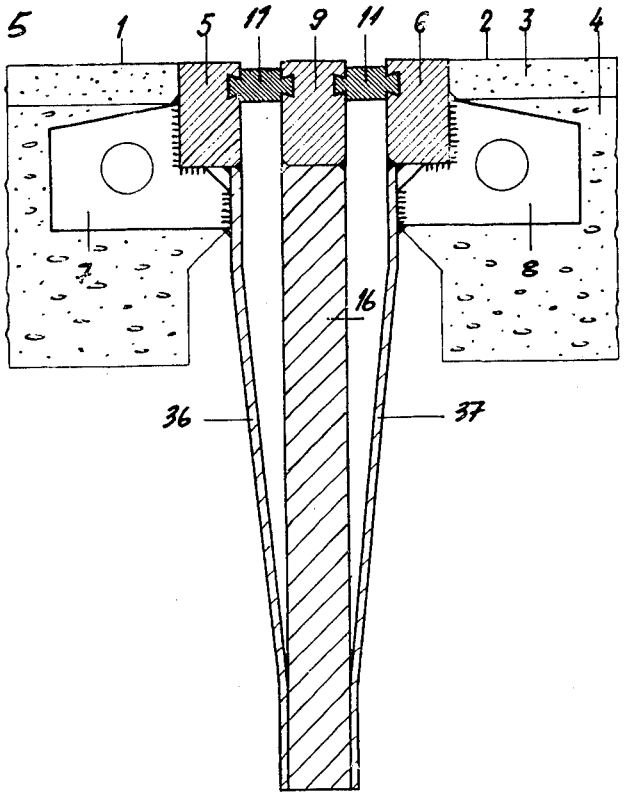
Figure 5A:
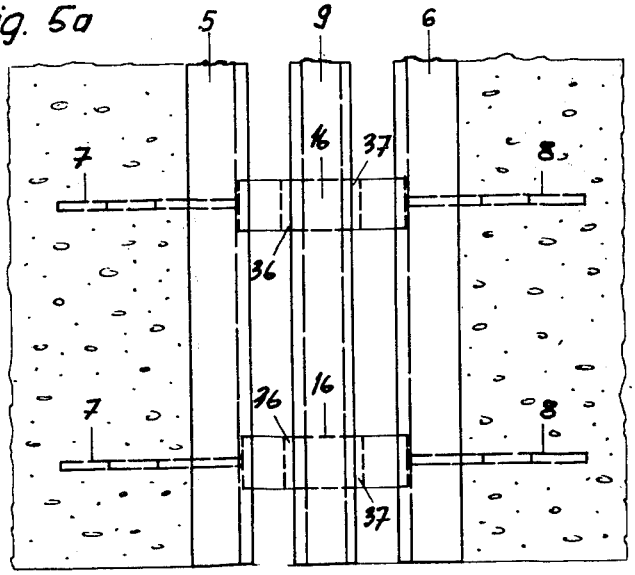

In the example of embodiment according to FIGS. 5 and 5*a* the supports 16 are formed as bars of rectangular cross-section and downwardly converging flat sections 36 and 37 which are elastically flexible in the longitudinal direction of the roadway serve as lateral supports.

Figure 6:
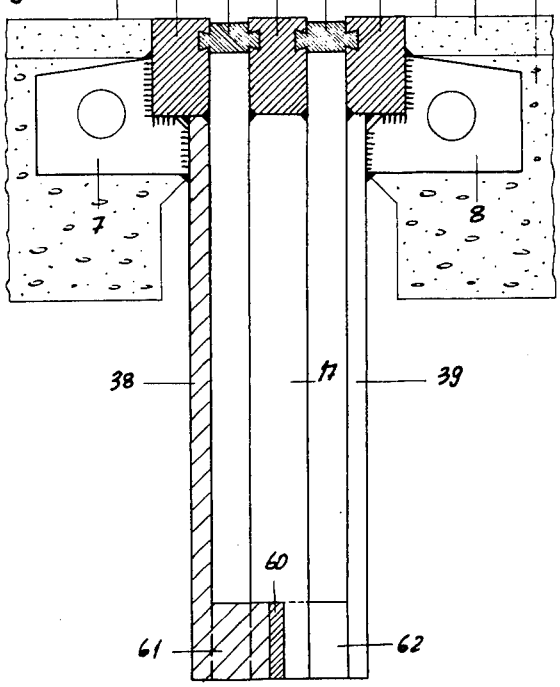
Figure 6A:
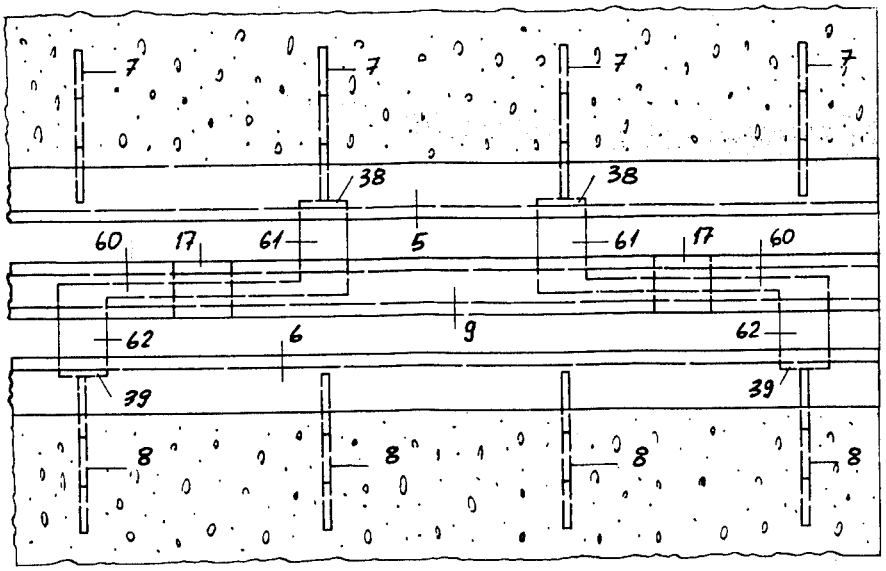

In the example according to FIGS. 6 and 6*a* the supports 17 formed as square sections are provided at the lower end each with an elastically flexible flat section 60 placed on edge, which protrudes in the longitudinal direction of the joint to both sides and is connected with the lateral supports 38 and 39 by means of intermediate pieces 61 and 62 arranged at its ends.

Figure 7:
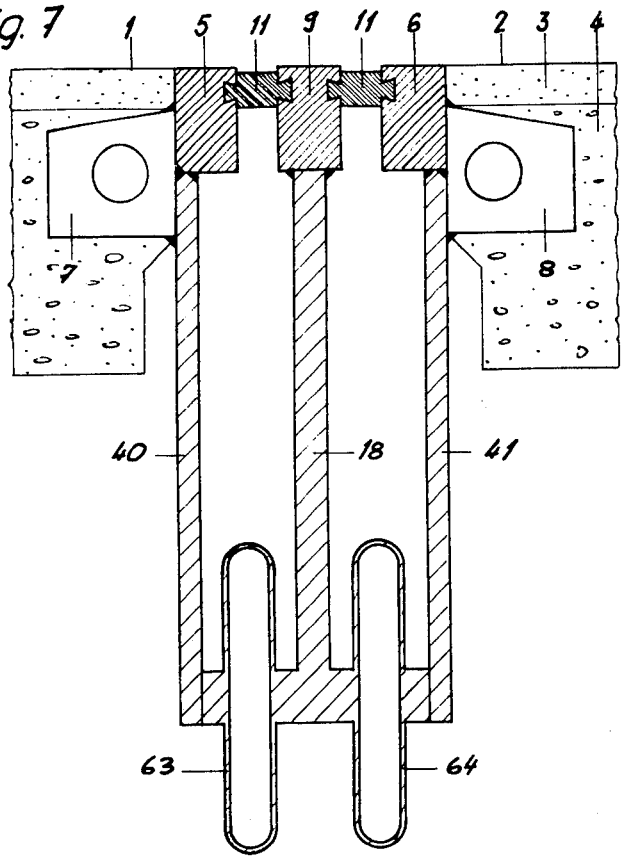
Figure 7A:
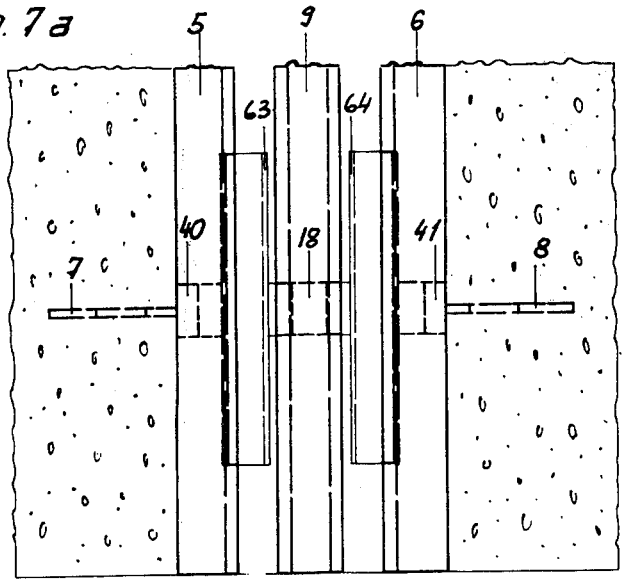

In the example of embodiment according to FIGS. 7 and 7*a*, O-shaped spring elements 63 and 64 which are elastically deformable in the longitudinal direction of the roadway are installed between each support 18 and the two lateral supports 40 and 41, which spring elements render possible an elastic expansion and contraction of the expansion joint.

Figure 8:
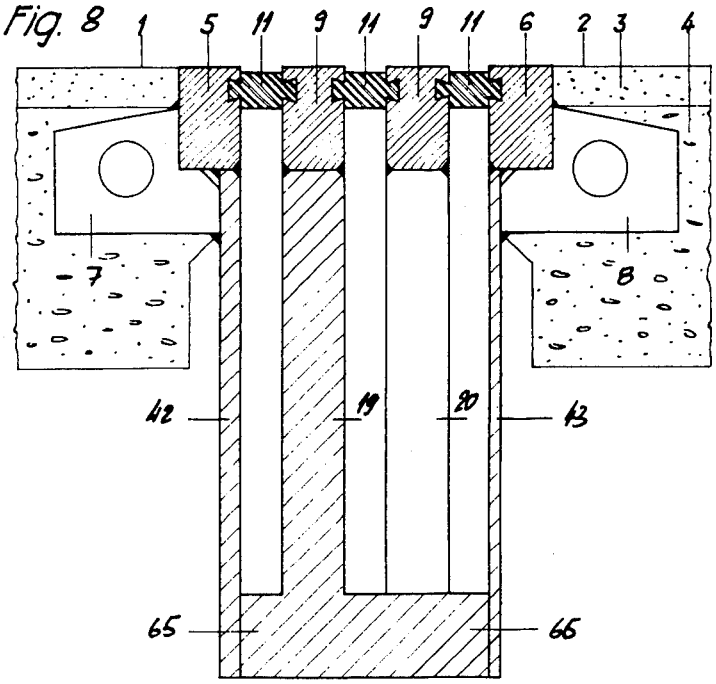
FIGS. 8 to 10 show three further examples of embodiment of expansion joints with four plates, in vertical cross-section.
Figure 8A:
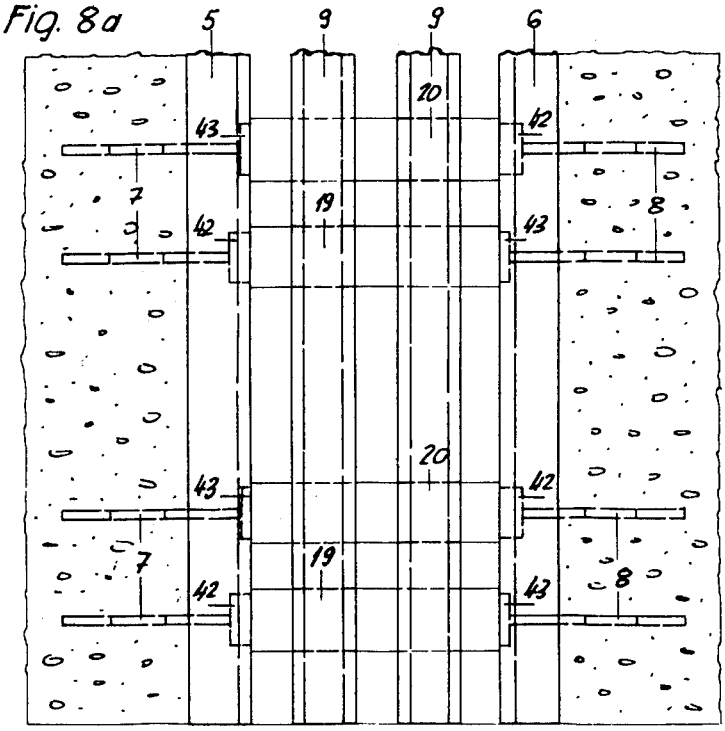

In the example of embodiment according to FIGS. 8 and 8*a* each support 19, 20 has legs 65 and 66 of different lengths at the lower end. Correspondingly the lateral supports 42 and 43 have different bending resistance moments, namely the lateral support 43 adjoining the longer leg 66 has the lower moment. This is so that on a movement of the joint in the longitudinal direction of the roadway, apertures or interspaces which always remain the same result between the plates. The same effect can also be achieved if the lateral supports 42, 43 are made with different lengths or act on the supports at different distances from the plates.

Figure 8B:
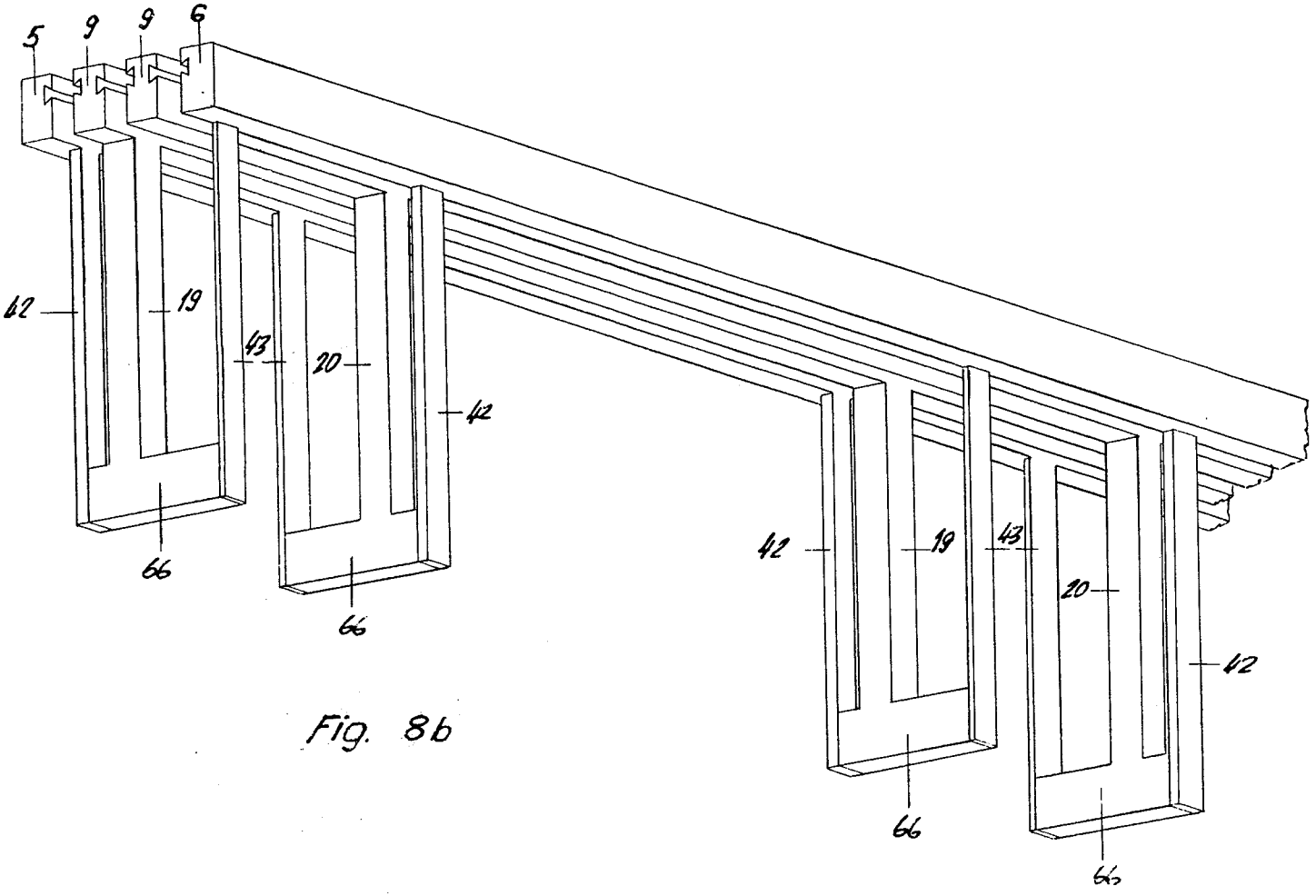
FIG. 8*b* shows the expansion joint as illustrated in FIGS. 8 and 8*a* without the joint edges and seal elements, in perspective representation.

FIG. 8*b* shows a perspective representation of the example of embodiment according to FIGS. 8 and 8*a*. From this it may be seen that the longer legs 66 of each two successive supports 19, 20 protrude to mutually opposite sides. In this example with four plates again each support 19, 20 is connected through the lateral supports 42 and 43 directly with the edge plates 5 and 6.

Figure 9:
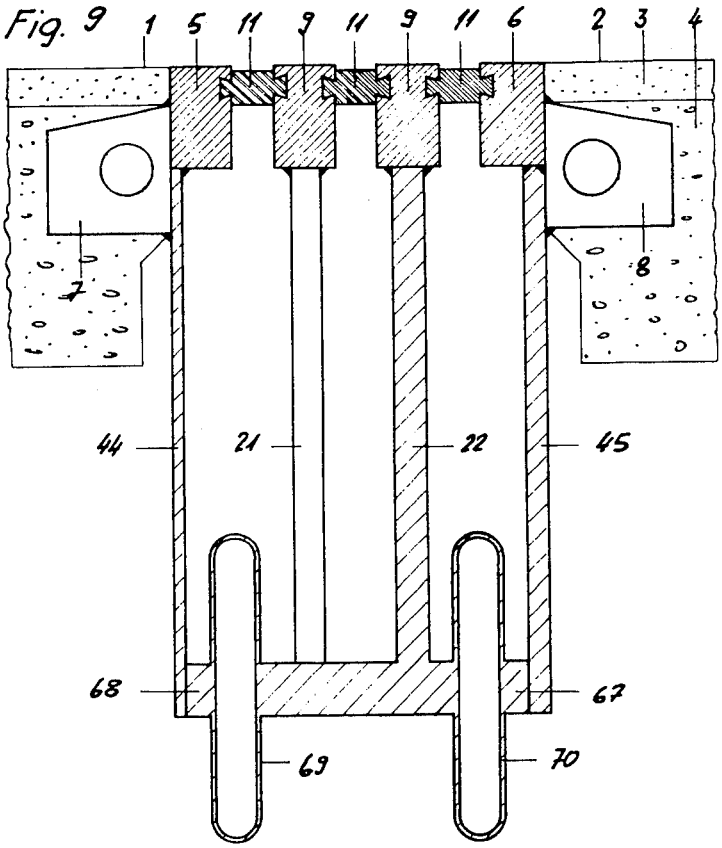
Figure 9A:
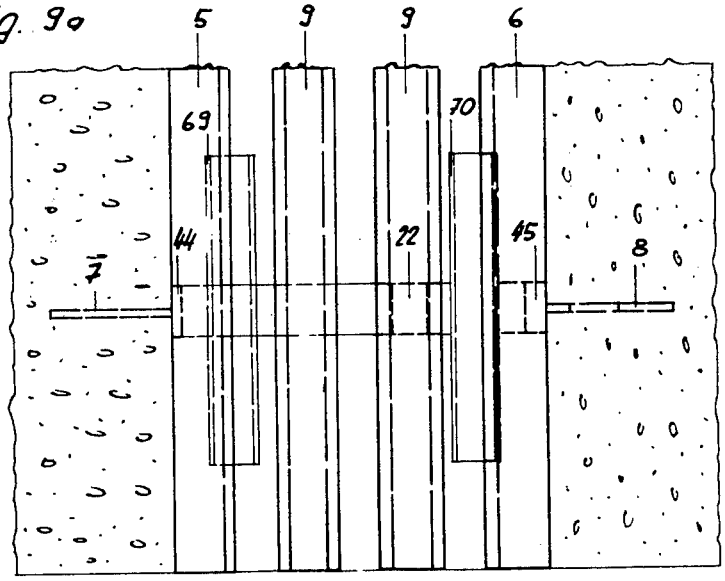
FIG. 9*b* shows the expansion joint as illustrated in FIGS. 9 and 9*a* without the joint edges and seal elements, in perspective representation.

The example of embodiment according to FIGS. 9 and 9*a* corresponds in principle to that according to FIGS. 8 and 8*a*, with the difference that as in the example according to FIGS. 7 and 7*a*, O-shaped spring elements 69, 70 are installed between the supports 21, 22 and the lateral supports 44 and 45 and in the legs 67 and 68.

Figure 9B:
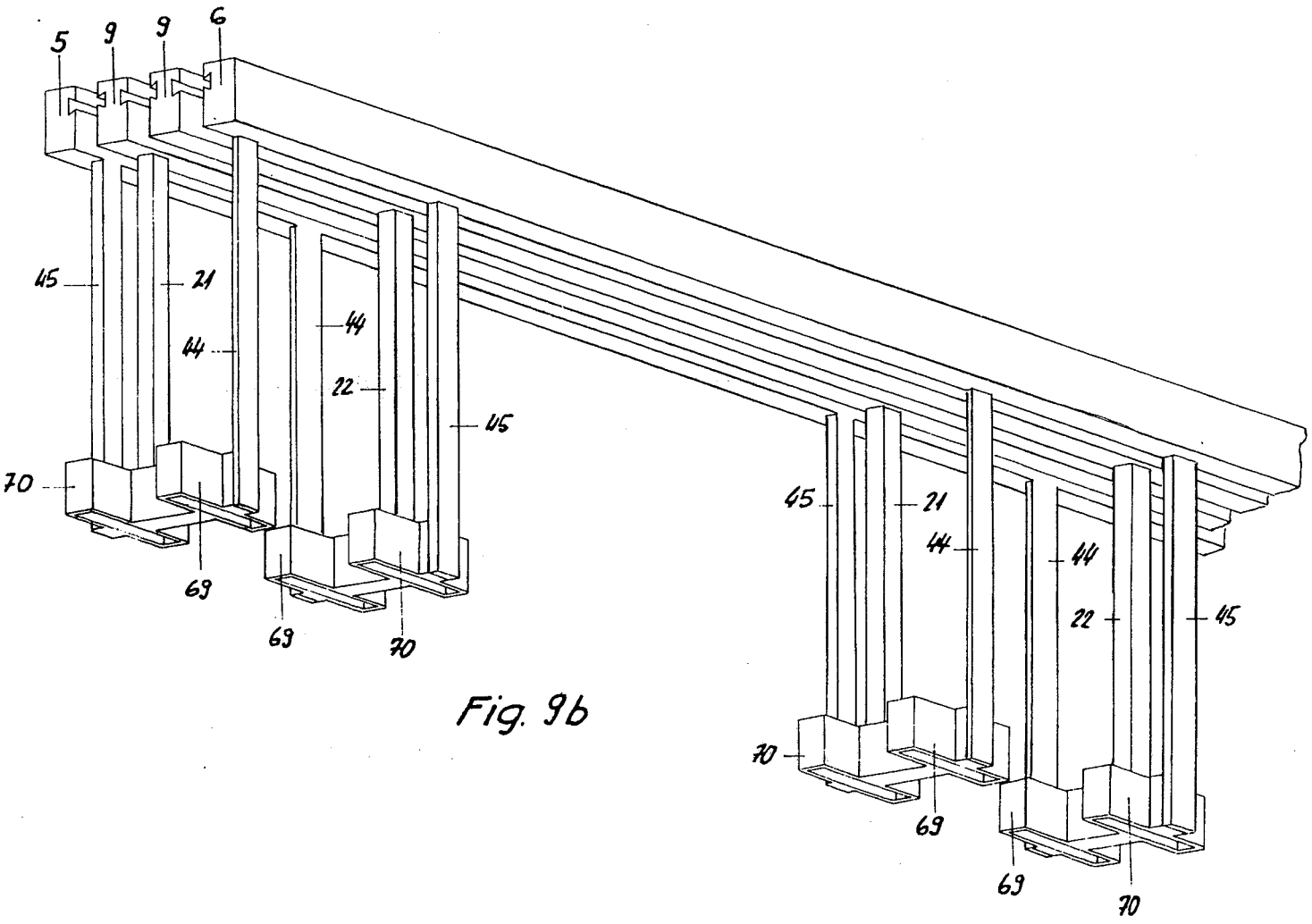

FIG. 9*b* shows in perspective representation the example of embodiment as illustrated in FIGS. 9 and 9*a*.

Figure 10:
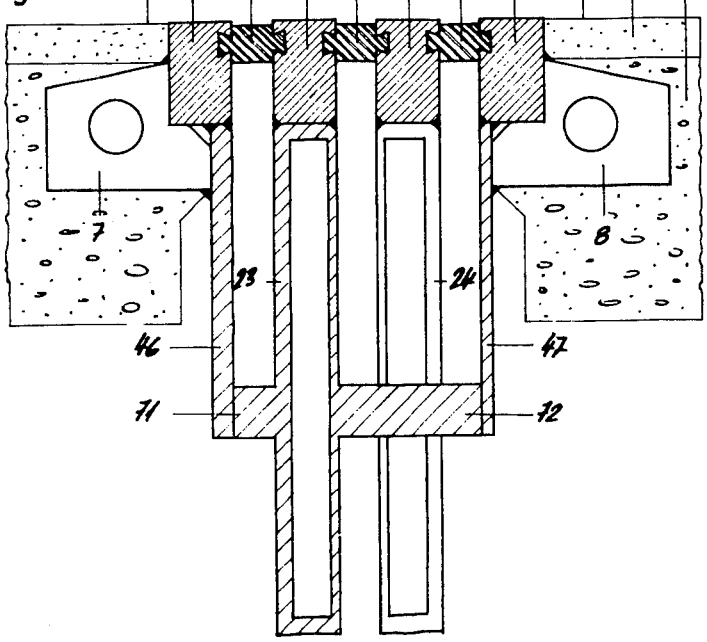
Figure 10A:
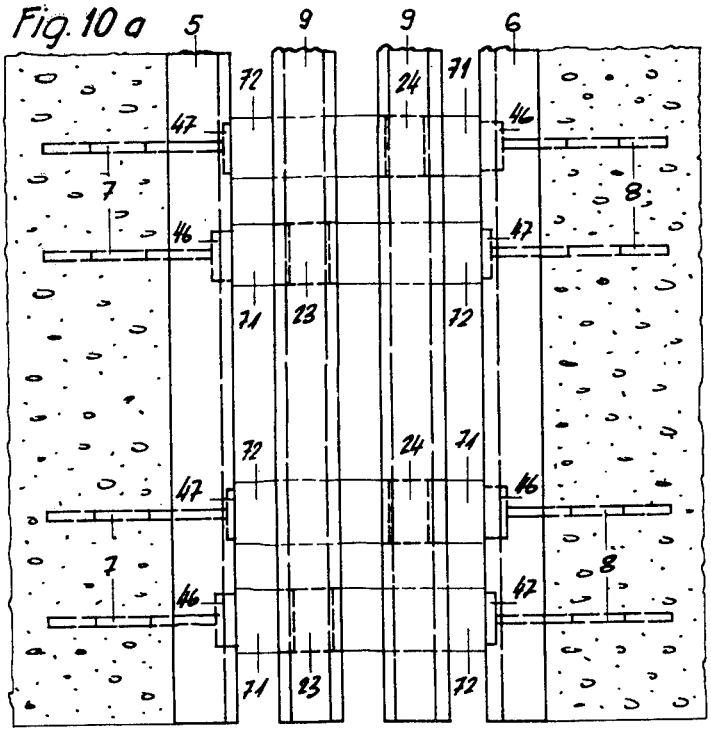

In the example of embodiment according to FIGS. 10 and 10*a* the supports 23, 24 in vertical section have the form of hollow profiled sections with resiliently elastic side walls and legs 71, 72 of unequal length. The side walls of the supports here have different bending resistance moments, namely the side walls 47 adjoining the longer legs 72 have the smaller moments. In contrast with the example according to FIGS. 8 and 8*a* the legs 71, 72 are not arranged at the lower ends of the supports but somewhat beneath the middle of the height thereof, in order to increase the spring effect of the hollow supports.

Figure 11:
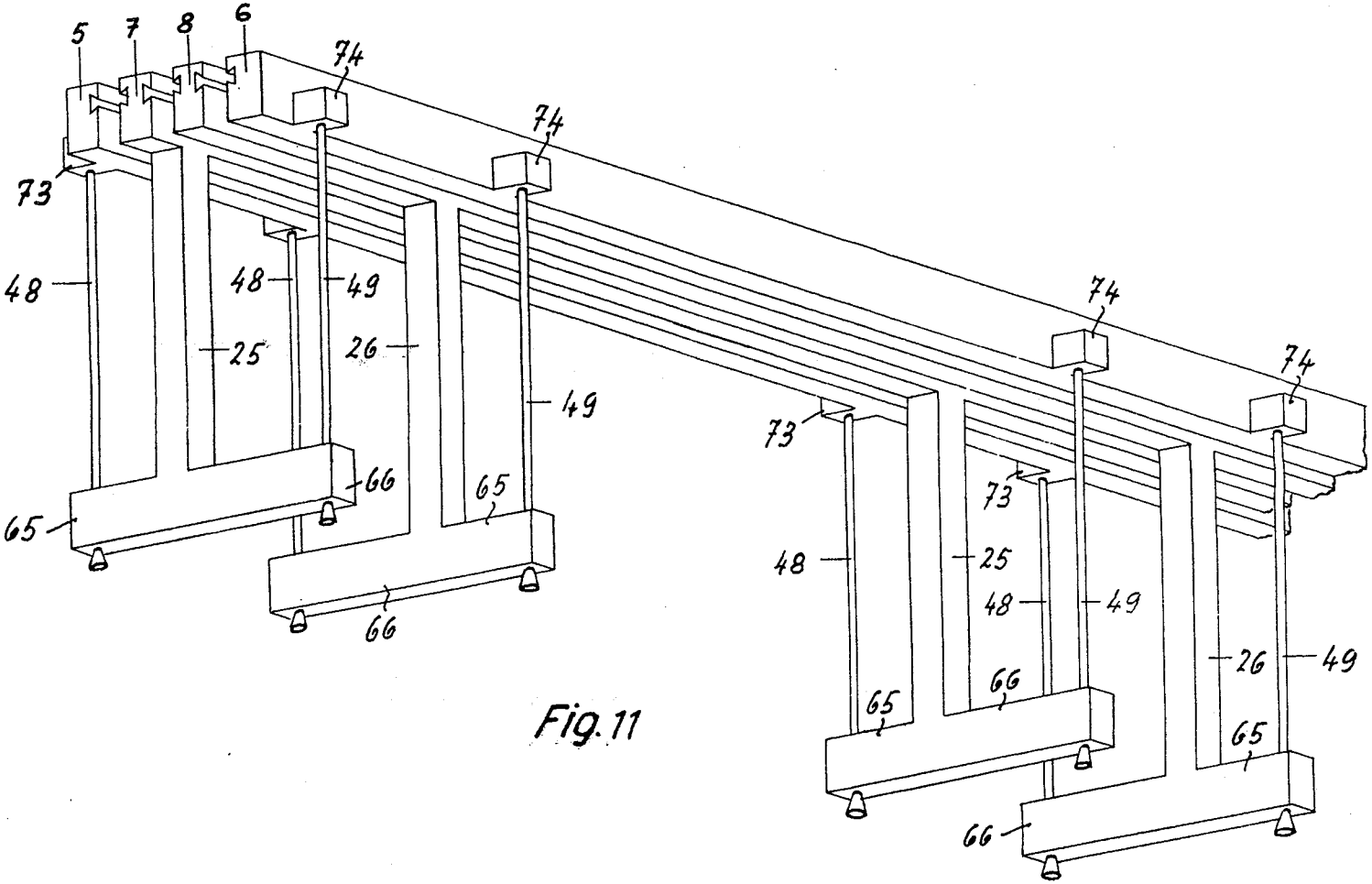
FIG. 11 shows a further example of embodiment of an expansion joint with four plates, without the joint edges and seal elements, in perspective representation.

In the example of embodiment according to FIG. 11 with four plates, as lateral supports there serve rods 48 and 49 which are anchored at one end in the legs 65, 66 of the supports 25, 26 and at the other in lateral eyes 73, 74 of the edge plates 5, 6.

FIGS. 12 to 16 show various possiblities of securing rods 75 to 79 serving as lateral supports to the edge plates and partly also to the supports, while FIGS. 17 to 22 show by way of example how cables 32 and 80 to 83 serving as lateral supports can be secured to the edge plates and in part also to the supports, and in fact FIG. 17 shows the securing of a cable 80 by means of straps 84, FIG. 18 the securing of a cable 32 with a press-on threaded sleeve 49, FIG. 19 the anchoring of the upper cable end in a sealing head 85 and FIGS. 20 to 22 the securing of cables 82, 83 with upper end of loop form.

Figure 23:
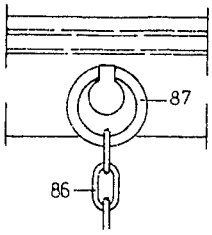
Figure 24:
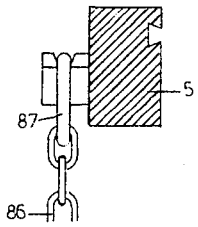
Figure 25:
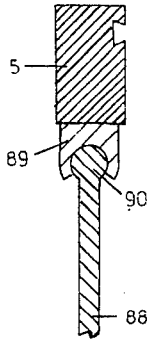

FIGS. 23 and 24 show the possibility of securing a chain 86, serving as lateral support by means of a ring eye 87 and finally FIG. 25 shows the securing of a rod 88, serving as lateral support, with the aid of a ball head 90 seated in a joint socket 89.

In all the examples of embodiment as illustrated and described, each support is connected directly with the two outer plates, while the lateral supports are subjected exclusively to tension stress by the traffic load. The bending stresses upon the lateral supports resulting in the expansion and contraction of the expansion joint are practically insignificant; in any case they are eliminated when cables or chains are used as lateral supports.

When vehicles passing over the expansion joint are braked and accelerated, transverse forces act upon the intermediate plates which can lead to local variations of the gap widths between the plates. However experience has shown that the elastic seal elements 11 arranged between the plates are entirely adequate to take up these transverse forces, so that the plates do not collide nor do gap widths result which are unacceptable for traffic.

FIGS. 26 and 27 show how such transverse forces can be additionally counteracted and the movement of the intermediate plates can be kept under control. For this purpose elements 91, 92 of hook form are secured to the edge plates 5, 6 and engage with clearance each behind the adjacent intermediate plate, while in the case of a plurality of intermediate plates, as illustrated in FIGS. 12 and 13, the intermediate plates are likewise provided with elements 93, 94 and 95, 96 of hook form which each engage with clearance behind the next intermediate plate.

I claim:

1. A device bridging over an expansion joint in a roadway and the like, especially in a bridge roadway, said device comprising:

a. a first edge plate extending in the joint longitudinal direction arranged at roadway level and anchored in one joint edge;

b. a second edge plate extending in the joint longitudinal direction, arranged at roadway level and anchored in the other joint edge;

c. at least one intermediate plate arranged between and spaced from said first and second edge plates;

d. elastically deformable seal elements provided between said intermediate plate and said first and second edge plates;

e. first downwardly extending flexible lateral supports supporting said first edge plate;

f. second downwardly extending flexible lateral supports supporting said second edge plate; and g. downwardly extending intermediate supports supporting the intermediate plate;

said intermediate supports each being connected to at least one of said first lateral supports and to at least one of said second lateral supports.

2. A device according to claim 1, in which the intermediate supports have an inverted T-shaped cross-section, the legs of which are each secured to a said lateral support.

3. A device according to claim 1, in which the intermediate supports in cross-section have the form of an elongated upright rectangle, and the device further comprises connection pieces are inserted between the supports and the lateral supports.

4. A device according to claim 1 in which each intermediate support comprises a vertical web having two legs of unequal length protruding to opposite sides thereof, each leg being secured to a said lateral support.

5. A device according to claim 4, in which the lateral supports have different bending resistance moments, the lateral support secured to the longer leg having the lower bending moment.

6. A device according to claim 5 in which the intermediate supports in vertical section have the form of hollow profiled sections with resiliently elastic side walls which have different bending resistance moments, the side walls adjoining the longer legs having the smaller moment.

7. A device according to claim 1, in which the lateral supports are formed by tension cables.

8. A device according to claim 1, in which the lateral supports are formed by draw rods.

9. A device according to claim 1, in which the lateral supports are formed by chains.

10. A device according to claim 1, in which each said intermediate support divides into two downwardly diverging legs, the lower ends which are interconnected by a cross-piece.

11. A device according to claim 1, in which at the lower end of each of said intermediate supports there is arranged a flat section placed on edge which protrudes to both sides in the longitudinal direction of the joint and is connected by means of intermediate pieces with said lateral supports.

12. A device according to claim 1, in which spring elements which are elastically deformable in the longitudinal direction of said intermediate roadway are installed between the supports and the associated lateral supports.

13. A device according to claim 1, in which the intermediate supports in vertical section have the form of hollow profiled sections with resiliently elastic side walls.

14. A device according to claim 1, in which for the limitation of the movement of the intermediate plates in the direction of the roadway, hook-shaped elements are secured to the edge plates, which elements each engage with clearance behind an adjacent said intermediate plate, and in which, in the case of a plurality of intermediate plates, the intermediate plates are likewise provided with hook-shaped elements which each engage with clearance behind the next intermediate plate.

15. A device according to claim 1, in which opposite pairs of said lateral supports converge downwardly towards a said intermediate support and in which each said intermediate support is formed by a vertical web having a lower end rigidly secured to the lower ends of said downwardly converging lateral supports.

* * * * *